US007725955B1

(12) United States Patent
Johnson

(10) Patent No.: US 7,725,955 B1
(45) Date of Patent: Jun. 1, 2010

(54) RIVALRY RIP-OFF APPAREL

(76) Inventor: James L. Johnson, 2003 Wayne St., Erie, PA (US) 16503

( * ) Notice: Subject to any disclaimer, the term of this patent is extended or adjusted under 35 U.S.C. 154(b) by 0 days.

(21) Appl. No.: 12/070,954

(22) Filed: Feb. 21, 2008

(51) Int. Cl.
*A41B 1/08* (2006.01)
*A41B 1/00* (2006.01)

(52) U.S. Cl. ..... 2/115; 2/69; 40/586

(58) Field of Classification Search ..... 2/1, 2/113, 115, 69, 108, 94, 95, 85, 102, 105, 2/106, 244, 242, 243.1; 40/586
See application file for complete search history.

(56) References Cited

U.S. PATENT DOCUMENTS 4,354,282 A * 10/1982 Langdon ..... 2/115
4,999,848 A * 3/1991 Oney ..... 2/115
5,052,056 A * 10/1991 Braun ..... 2/115
5,845,334 A * 12/1998 Marcolini, Jr. ..... 2/69
6,185,746 B1 * 2/2001 Scott ..... 2/115
6,550,066 B1 * 4/2003 Brassey ..... 2/93

* cited by examiner

*Primary Examiner*—Gloria Hale
(74) *Attorney, Agent, or Firm*—Richard K. Thomson

(57) ABSTRACT

A cap, jacket, shirt, or sweatshirt displaying the logos of two rival adjacent a field, court, mat or rink depicting the sport in which the teams vie. These logos may be readily ripped-off, being attached by hook-and-loop fabric, or the like, to enable the following week's rivalry to be displayed on the same item of apparel. The wearer's preference is displayed on that item of apparel by means of a team name/logo/exhortational message displayed elsewhere on the item than in the display region and by a red 'DIS' cord stretched across the team the wearer wishes to lose in a manner reminiscent of the international NOT! display.

14 Claims, 2 Drawing Sheets

RIVALRY RIP-OFF APPAREL

BACKGROUND AND SUMMARY OF THE INVENTION

The present invention is directed to the field of clothing. More particularly, the present invention is directed to an article of clothing capable of displaying a rivalry of interest to the wearer and the wearer's preference for the outcome of a soon-to-be-played game or one of historic interest.

Sports have long been a passion for many and the number of fans for particular sports is expanding exponentially. Sports paraphernalia is proliferating and fans are looking for additional ways to display their love for their preferred team(s). It is an object of the present invention to present articles of apparel which allows the wearer to make clear to anyone seeing the person's attire, his/her preference for the outcome of a particular rivalry/game. This apparel may take the form of a cap or other type of hat, a sweatshirt, t-shirt, jacket, polo shirts, team jersey, vests, etc., available under the trademark Rivalry Rip-off™ apparel.

The present invention comprises an article of clothing for displaying a rivalry between two teams including: a) an apparel item having a display region for displaying at least two logos of rival teams; b) a first logo for a preferred team; c) a second logo for another rival team; d) attachment means for removably securing the first and second logos to the display region; e) indicator means for manifesting a preference of a wearer of the apparel item for one team over the other team. The article of clothing includes first attachment means for securing the first logo and second attachment means for securing the second logo to the display region which includes a field, court, pool, rink, or mat depicting a sport in which the rival teams compete with a 'VS' emblazoned on the field, court, pool, rink or mat between the first and second attachment means, as well as at least one indication adjacent one of the attachment sites indicating which is the home team.

Each of the first and second attachment means comprises first and second hook-and-loop fabric portions in which the first hook-and-loop fabric portion is secured to the display region and the second hook-and-loop fabric portion is secured to a back side of one of the first and second logos. The indicator means comprises a team name/logo/exhortational message of/for the wearer's preferred team displayed elsewhere on the apparel item. The indicator means further comprises a red cord stretched diagonally across the second logo. The article of apparel includes removable attachment means for the red cord allowing it to be draped across either side of the display region. It is envisioned that this Rivalry Rip-off™ apparel could apply to sports including baseball, basketball, diving, football, hockey, soccer, swimming, track and field, wrestling at all levels of competition and could easily be applied to non-athletic competitions, such as highschool and college scholastic meets, as well.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
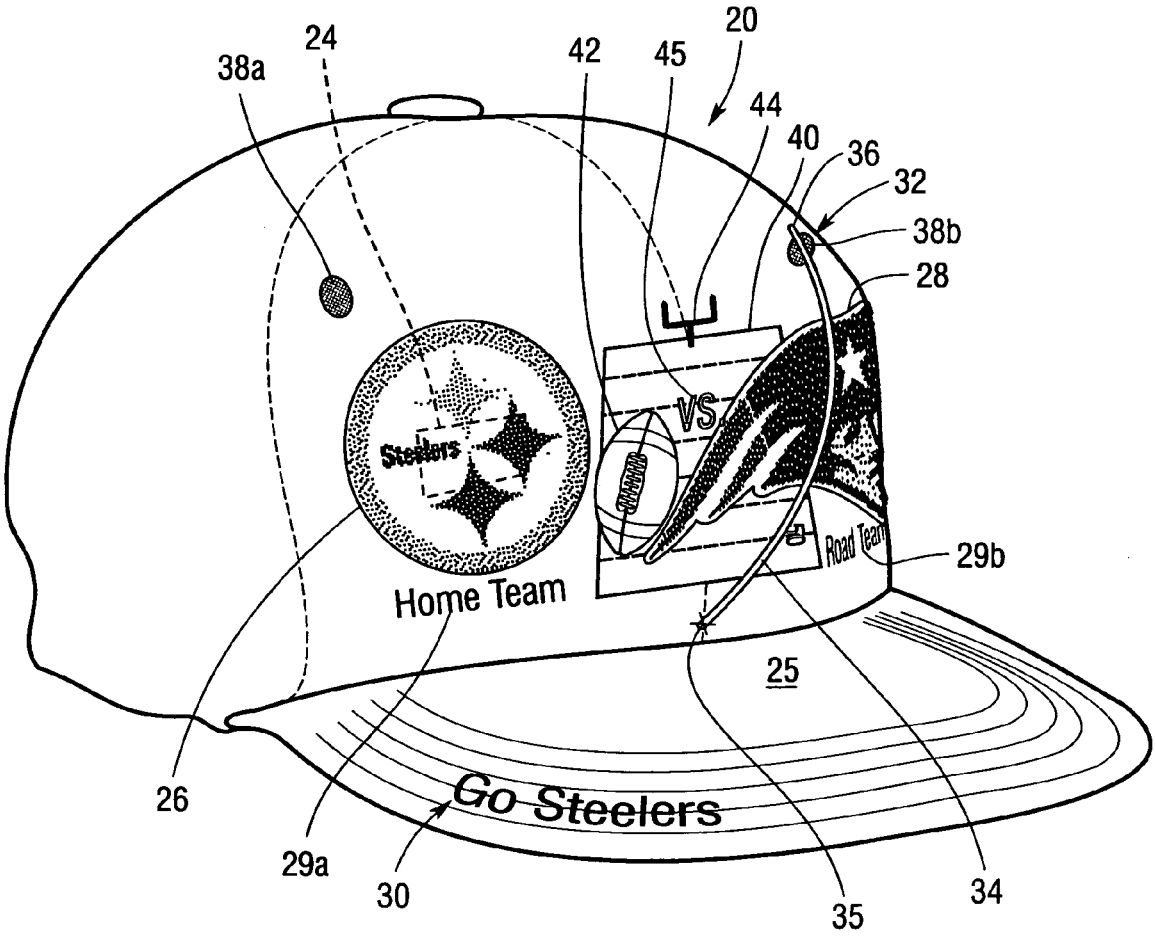
FIG. 1 is a perspective front view of a first embodiment of the Rivalry Rip-off™ apparel of the present invention.

A first embodiment of the Rivalry Rip-off™ apparel of the present invention is depicted in FIG. 1 generally at 20. In this first embodiment, the article of apparel 20 is depicted as a ball cap. The invention is equally applicable to an other type of hat, a sweatshirt, t-shirt, jacket, polo shirts, team jerseys, vests, etc. Cap 20 has a display region which in this embodiment is the front 22 of cap 20. First attachment means in the form of a first hook-and-loop (Velcro®) fabric portion 24 is attached to the front 22 of cap 20 enabling a first team logo 26 to be secured to the display region 22 with a corresponding portion of hook-and-loop fabric attached to the back of logo 26. Certain fabrics (fleece, for example) can be attached directly to hook-and-loop fabric portions without the need for a corresponding fabric portion attached to thereto. It is envisioned that for certain garments/applications, such an attachment technique could be employed herein. A second hook-and-loop fabric portion is employed to attach second logo 28 to display region 22. Although other means of fastening logos 26, 28 could be used, hook-and-loop fabric is preferred to enable the logos to be easily ripped-off and replaced with the next rivalry match-up to follow. At least one 'home team' designation 29*a* is positioned adjacent one of the two sites for attaching the first or second logos 26, 28. More preferably, an 'away team' or 'road team' designation 29*b* is positioned adjacent the second attachment site, as well.

The logos depicted in FIG. 1 are those of NFL teams. Positioned between the first and second attachment means on display region 22 is a depiction of the sport to which the logos relate, in this case, a football field 40 with a football 42 and goalpost 44. It will be appreciated that other sports might be displayed as well, in which case the field/court/pool/rink/mat will be altered to reflect baseball, basketball, diving, hockey, skiing, soccer, swimming, track and field, wrestling, or what have you. It is envisioned that the logos may be sold separately or in groups, kits with an entire league or division sold together to enable regularly scheduled rivalry match-ups to be depicted on the apparel 20. The specific match-up is communicated by the positioning of a 'V' or, as shown in FIG. 1, a 'VS' 45, on the field 40 between the two logos. While the specific sport depiction 40 and indicator means/preference logos 30 could be removably attached by hook-and-loop fabric, as well, it is preferred that the particular home team cap 20 be tailored for the individual team/sport and only the rivalry logos 26, 28 appearing in the display region 22 be removable/replaceable.

The invention further contemplates one or more indicator means to make the wearer's rooting affections readily apparent. A first indicator means 30 comprises a team name/logo or "GO TEAM!" exhortation message displayed prominently on some portion of the cap 20. While being shown in FIG. 1 as placed on the brim 25 of cap 20, it will be understood that this is merely representative of the location and suitable display areas could include one or more of both sides and back, as well as the brim 25. A second indicator means 32 comprises a red cord 34 with a first end 35 stitched to the cap front 22 in the center with the opposite end 36 secured to either of two hook-and-loop fabric portions 38*a*, 38*b* depending on whether the wearer's favorite team is the home team or the away team. Red 'DIS' cord 34 will be stretched across the opponent's logo in a manner reminiscent of the international depiction for 'NO' or 'NOT! '. While the bottom end 35 is shown attached in the center of the cap front 22, it will be appreciated that the top end 36 could be fixed and the bottom end 35 moved between hook-and-loop fabric portions 38*a*, 38*b* which would then be just above the brim 25. Further, it will be understood the attachment method used with the second embodiment could be used in this first embodiment, as well.

Figure 2:
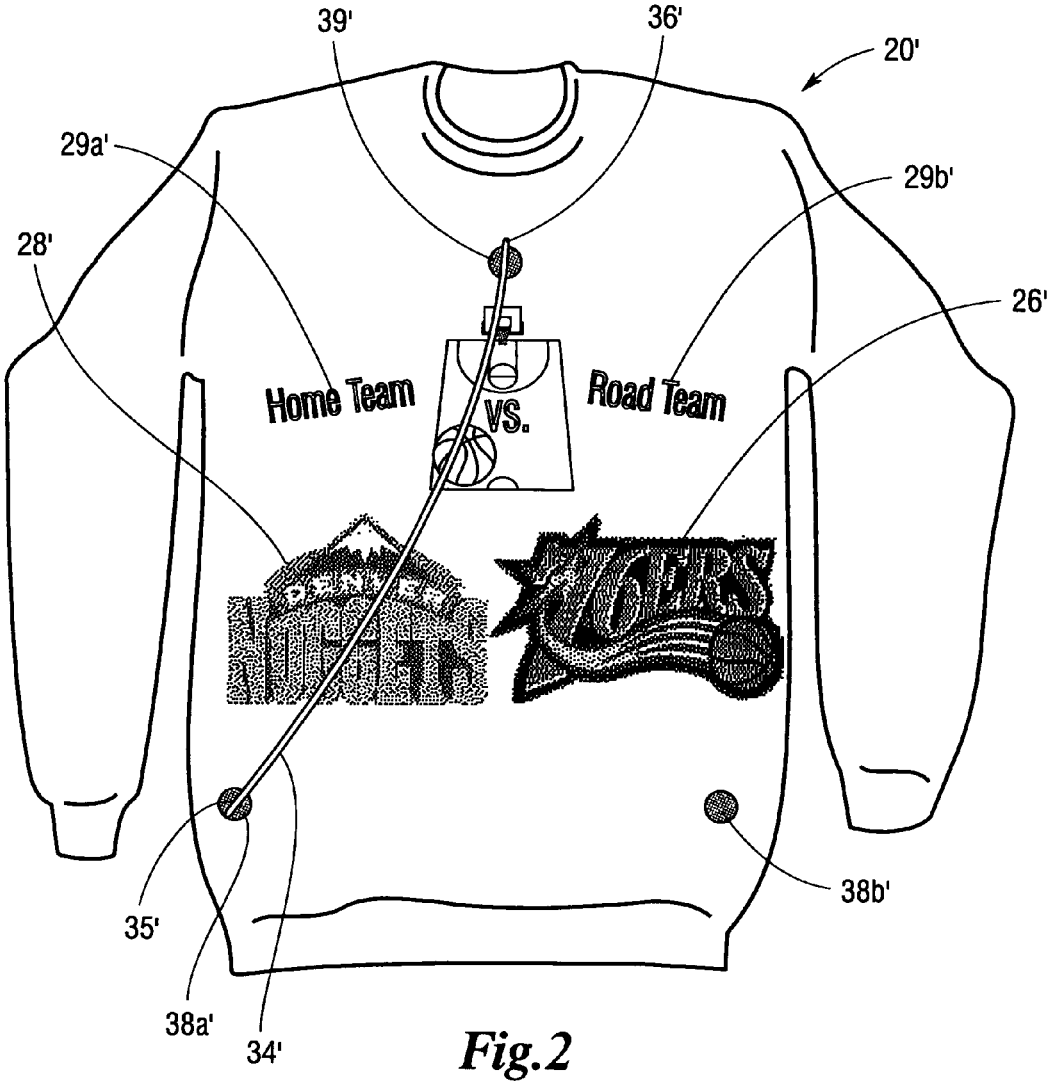
FIG. 2 is a perspective front view of a first second embodiment.

A second embodiment of the present invention is depicted in FIG. 2 as a sweatshirt 20'. In this embodiment, the home team/road team designations 29*a*', 29*b*' are positioned above the logo attachment sites. Further, the red 'DIS' cord 34' has been adjusted in length to accommodate the larger item of apparel 20' and both ends 35' and 36' are attached using hook-and-loop fabric 38*a*', 38*b*' and 39', respectively, to facilitate laundering of the garment 20'. It will further be appreciated that due to the larger size of the logos 26', 28', larger and/or more likely, multiple pieces of hook-and-loop fabric will be utilized to attach the logos 26', 28' to the display region 22'.

It will be appreciated that the apparel 20 of the present invention uniquely enables a fan to display a rivalry of an upcoming/historic game and to clearly evidence his team loyalty. It will further be appreciated that while the preferred configuration of the present invention shown in the first embodiment depicts two forms of indication means (i.e., uses both an exhortational message 30 and a red 'DIS' cord 32, each form of indication means could be used separately Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. An article of clothing for displaying a rivalry between two teams comprising:

a) an apparel item having a display region for displaying at least two logos, one each of two rival teams, said display region comprising an entire front planar region of said article of clothing;

b) a first removable logo for a first preferred team;

c) a second removable logo for a second rival team;

d) attachment means for removably securing said first and second removable logos to said display region;

e) indicator means for manifesting a preference of a wearer of said apparel item for one team over the other rival team said indicator means including a repositionable cord having one end permanently attached to said apparel item, stretchable diagonally across either side of said display region; and f) said display region including a field, court, mat or rink depicting a sport in which the rival teams compete with a 'VS' emblazoned on said field, court, mat or rink between said first and second attachment means.

2. The article of clothing of claim 1 wherein said attachment means comprises first attachment means for securing said first logo and second attachment means for securing said second logo to said display region.

3. The article of clothing of claim 1 wherein each of said first and second attachment means comprises first and second hook-and-loop fabric portions in which said first hook-and-loop fabric portion is secured to said display region and said second hook-and-loop fabric portion is secured to a back side of one of said first and second logos.

4. The article of clothing of claim 3 wherein said indicator means comprises a team name/logo/exhortation message of the wearer's preferred team displayed elsewhere on said apparel item other than in said display region.

5. The article of clothing of claim 4 wherein said indicator means further comprises a repositionable red cord having one end permanently attached to said apparel item, stretched diagonally across said second logo.

6. The article of apparel of claim 5 further comprising removable attachment means for said red cord allowing said red cord to be draped across either side of said display region.

7. The article of apparel of claim 1 further comprising indica means written adjacent at least one of said first and second attachment means to indicate which of said first and second logos belongs to a home team.

8. The article of apparel of claim 1 wherein said indicator means comprises a red cord stretched diagonally across said second logo.

9. The article of apparel of claim 1 wherein said indicator means comprises a team name/logo/exhortation message of the wearer's preferred team displayed elsewhere on said apparel item other than in said display region.

10. An article of clothing for displaying a rivalry between two teams comprising:

a) an apparel item having a display region for displaying at least two logos, one each of two rival teams, said display region includes a field, court, mat or rink depicting a sport in which the rival teams compete with a 'VS' emblazoned on said field, court, mat or rink between said at least two logos, said display region comprising an entire front planar region of said article of clothing;

b) a first removable logo for a first preferred team;

c) a second removable logo for a second rival team;

d) attachment means for removably securing said first and second removable logos to said display region;

e) indicator means for manifesting a preference of a wearer of said apparel item for one team over the other rival team, said indicator means including a repositionable cord having one end permanently attached to said apparel item, stretchable diagonally across either side of said display region, and f) indicia written at least adjacent one of said first and second attachment means indicating which logo belongs to a home team.

11. The article of clothing of claim 10 further comprising additional indicia means written along at least one other of said first and second attachment means indicating which logo belongs to a visiting team.

12. An article of clothing for displaying a rivalry between two teams comprising:

a) an apparel item having a display region for displaying at least two logos, one each of two rival teams;

b) a first removable logo for a first preferred team;

c) a second removable logo for a second rival team;

d) attachment means for removably securing said first and second removable logos to said display region;

e) indicator means for manifesting a preference of a wearer of said apparel item for one team over the other rival team, said indicator means including a repositionable red cord having one end permanently attached to said apparel item, stretchable diagonally across either side of said display region.

13. The article of clothing of claim 12 further comprising indicia written at least adjacent one of said first and second attachment means indicating which logo belongs to a home team.

14. The article of clothing of claim 13 further comprising additional indicia means written along at least one other of said first and second attachment means indicating which logo belongs to a visiting team.

* * * * *